US009163358B2

(12) United States Patent
Kettunen

(10) Patent No.: US 9,163,358 B2
(45) Date of Patent: Oct. 20, 2015

(54) METHOD AND ASSEMBLY FOR PROCESSING CELLULOSE PULP OF WOOD PROCESSING INDUSTRY

(75) Inventor: Auvo Kettunen, Kotka (FI)

(73) Assignee: Andritz OY, Helsinki (FI)

( * ) Notice: Subject to any disclaimer, the term of this patent is extended or adjusted under 35 U.S.C. 154(b) by 44 days.

(21) Appl. No.: 13/393,785

(22) PCT Filed: Aug. 31, 2010

(86) PCT No.: PCT/FI2010/050675

§ 371 (c)(1),
(2), (4) Date: Apr. 18, 2012

(87) PCT Pub. No.: WO2011/027029

PCT Pub. Date: Mar. 10, 2011

(65) Prior Publication Data

US 2012/0193050 A1 Aug. 2, 2012

(30) Foreign Application Priority Data

Sep. 1, 2009 (FI) ..... 20090313

(51) Int. Cl.

| | |
|---|---|
| ***D21C 11/00*** | (2006.01) |
| ***D21C 9/04*** | (2006.01) |
| ***D21C 9/147*** | (2006.01) |

(52) U.S. Cl.

CPC *D21C 9/04* (2013.01); *D21C 9/147* (2013.01); *D21C 11/00* (2013.01); *D21C 11/0028* (2013.01)

(58) Field of Classification Search

CPC ..... D21D 5/00
USPC ..... 162/55, 251, 261
See application file for complete search history.

(56) References Cited

U.S. PATENT DOCUMENTS

| | | | | |
|---|---|---|---|---|
| 3,666,619 | A * | 5/1972 | Malhos et al. | 162/30.11 |
| 5,147,504 | A * | 9/1992 | Henricson et al. | 162/55 |
| 5,788,812 | A * | 8/1998 | Agar et al. | 162/16 |
| 5,919,337 | A | 7/1999 | Olsson et al. | |
| 2002/0088567 | A1 | 7/2002 | Henricson et al. | |

FOREIGN PATENT DOCUMENTS

| | | | |
|---|---|---|---|
| EP | 0 716 182 | A2 | 6/1996 |
| WO | 94/11567 | A1 | 5/1994 |
| WO | 96/17996 | A1 | 6/1996 |
| WO | 00/47812 | A1 | 8/2000 |
| WO | 00/73575 | A1 | 12/2000 |
| WO | 02/088461 | A1 | 11/2002 |
| WO | 2006/071165 | A1 | 7/2006 |

OTHER PUBLICATIONS

Me Botnialaiset, May 2003,pp. 12-13.
PCT International Preliminary Report on Patentability issued Mar. 6, 2012.
Supplementary European Search Report cited in EP Patent Application No. 10 81 3389 mailed Nov. 28, 2013.

* cited by examiner

*Primary Examiner* — Jacob Thomas Minskey
(74) *Attorney, Agent, or Firm* — Nixon & Vanderhye P.C.

(57) ABSTRACT

A method of and an apparatus for processing cellulose pulp of wood processing industry. The method and assembly may be used, on one hand, as a pressure diffuser for washing the pulp before an oxygen stage and, on the other hand, the separation of soap, gas and/or other light materials from filtrates and from black liquor of a cellulose mill in a pressurized device, as well as the new process connections enabled by the method. The method and apparatus may process filtrates from brown stock washing and bleaching as well as black liquors from a digesting department and an evaporation plant. By way of example, the filtrate of the washing department is pumped to the digesting department of a sulfate cellulose mill as well as the black liquor taken from the digesting department to an evaporation plant.

47 Claims, 5 Drawing Sheets

METHOD AND ASSEMBLY FOR PROCESSING CELLULOSE PULP OF WOOD PROCESSING INDUSTRY

RELATED APPLICATION

This application is the U.S. national phase of International Application No. PCT/FI2010/050675 filed 31 Aug. 2010 which designated the U.S. and claims priority to 20090313 filed 1 Sep. 2009, the entire contents of each of which are hereby incorporated by reference.

BACKGROUND

A method and an assembly is disclosed herein for processing cellulose pulp of wood processing industry. Especially, the disclosed method and assembly may be used, on the one hand, as a pressure diffuser for washing the pulp before an oxygen stage and, on the other hand, for the separation of soap, gas and/or other light materials from filtrates and black liquor of a cellulose mill in a pressurized device, as well as the process connections enabled by the method. The disclosed method and assembly are suitable for processing filtrates from brown stock washing and bleaching as well as black liquors from a digesting department and an evaporation plant. For example, the filtrate of the washing department pumped to the digesting department of a sulfate cellulose mill as well as the black liquor taken from the digesting department to an evaporation plant.

Extractives and resin present in wood react in the sulfate cellulose digesting process with alkaline digesting chemicals and form various compounds generally referred to as soap. The amount of soap when digesting softwood pulp is typically approximately 20 to 80 kg per a ton of pulp. When digesting hardwood pulp, the amount of soap obtained is considerably smaller. In solutions of the prior art, soap is washed away from the pulp in a digester and in the brown stock washing and is thereafter carried along with black liquor to an evaporation plant. At the evaporation plant, soap is separated from black liquor and acidified to tall oil. Tall oil is sold as a raw material for chemical industry or burned. A part of tall oil can be returned to the hardwood digesting to boost the dissolution of extractives from the pulp. Although soap is a useful raw material, when it gets to a wrong place it greatly interferes with various functions of a cellulose mill. If soap separation is not working at the evaporation plant and a significant amount of soap gets into evaporation units along with black liquor, it causes fouling and clogging of evaporators as well as foaming of the liquor whereby the condensates of the evaporation plant are contaminated unusable. In brown stock washing, soap disturbs the flow of washing water through the pulp and significantly weakens the washing efficiency of washers. Also, air is easily mixed with soap which also disturbs the washing of pulp. At the washing department, soap accelerates fouling of apparatus, too. At the digesting department, soap and possibly air along with it may cause malfunction and fouling of apparatus. Due to the several handicaps and for maximizing the yield of soap and tall oil, efficient separation of soap from filtrates and black liquor would be extremely advantageous. In solutions of prior art, soap is separated from filtrates and black liquor in various atmospheric pressure tanks in which soap, that has a lower density than filtrates and liquor, rises up to the surface. At the evaporation plant, soap on the surface in the tank is removed from the tank, for example, by overflow to a separate tank for further processing. If the retention time of filtrate or black liquor is not sufficient or if soap does not separate normally due to other reasons, such as incorrect dry content or alkality of black liquor, considerable amounts of soap are able to disturb the evaporation process. In the filtrate tanks of the washing department, soap is also separated onto the surface of the filtrate in the tank from which it is, in some cases, removed by overflow and taken to the evaporation plant along with black liquor. Usually, soap is not sought to be separated at the washing department area in any way, but it is converted into a more easily dissolving form using various expensive chemicals and washed away to the evaporation plant. If soap is not able to exit properly, it enriches in the filtrate tank and filtrate circulations until a balance is achieved. In cases like this, soap concentrations and process failures may be very large. If the digester wash or the washing of pulp in a digester is successful, most of the soap is directly displaced to black liquor and only small amounts of soap is carried along to the brown stock washing. In most digesters, however, the wash is not sufficient and significant amounts of soap is carried along to the brown stock washing during which it may be enriched to considerably high concentrations. Typical places where such enrichment takes place are the filtrate circulations between the digester and the first brown stock washer.

SUMMARY OF INVENTION

The aforementioned soap separation methods are expensive, ineffective and susceptible to malfunctions. For soap separation, large tanks and expensive chemicals are needed. In the solution disclosed herein, soap is efficiently, affordably and simply separated from filtrates and/or black liquor using one or more hydrocyclones or other pressurized separation apparatus. When compared to prior art, two significant advantages are achieved when separating soap using a pressurized apparatus. Firstly, pressure enables working at temperatures of over 100° C. Another advantage is that the gas and steam bubbles in soap are compressed when pressure rises thus reducing the volume of soap. For example, in washers utilizing a suction leg, there is sub atmospheric pressure in the suction leg and the pressure of filtrate corresponds in some part of the suction leg the steam pressure of the filtrate and steam bubbles are formed. The steam and gas bubbles formed in soap typically remain unbroken as filtrate flows into a tank and foam is formed on the surface of the filtrate tank. Even if one is able to separate foam by overflow, its processing is cumbersome due to the large volume. In addition to hydrocyclones, other pressurized soap separation apparatus may be, for example, a pressurized filtrate tank or apparatus including various rotating parts, such as centrifuges or pumps, from which fractions of higher and lower densities can be separated. There are no rotating or moving parts in a hydrocyclone; due to its simplicity it is thus very suitable for the task.

A hydrocyclone is an apparatus where fluid, in this case a mixture of filtrate/black liquor and soap, is led to a strongly vortical movement where less dense fractions move into the centre/along the longitudinal axis of the apparatus whereas the more dense fractions move towards the perimeter of the apparatus/onto the inside surface of the jacket. Utilizing this phenomenon, one is able to separate light fractions, in this case soap and air, as overflow of the cyclone from the heavier fractions, in this case from filtrate/black liquor, which are withdrawn as the underfloor of the hydrocyclone. Hydrocyclones are generally used in pulp mills, for example, for separating sand from filtrates or impurities from dilute pulp mixtures. In these cases, most of the fed liquid exits via a central outlet port in the centre/cover of the apparatus as the lighter fraction and only a small portion with impurities along the perimeter/jacket inner surface of the apparatus, most commonly via an outlet port in the opposite end of the apparatus. The solution of the invention functions contrary to the above, i.e. most of the liquid exits along the perimeter/jacket inner surface of the apparatus, usually via an outlet port in the opposite end of the apparatus, and only a small portion of the liquid exits as the lighter fraction via a central outlet port in the centre/cover of the apparatus. Depending on the application in question, one may use a single hydrocyclone or more than one parallel or series coupled hydrocyclones. Although the discussion below relates generally to a single hydrocyclone it is always possible, in a corresponding application, to use more than one hydrocyclones using various connections.

The characteristic features of the method and the assembly of the present invention are disclosed in the appended claims.

SUMMARY OF FIGURES

In the following, the present invention is described in more detail referring to the appended figures, wherein.

DETAILED DESCRIPTION

Figure 1:
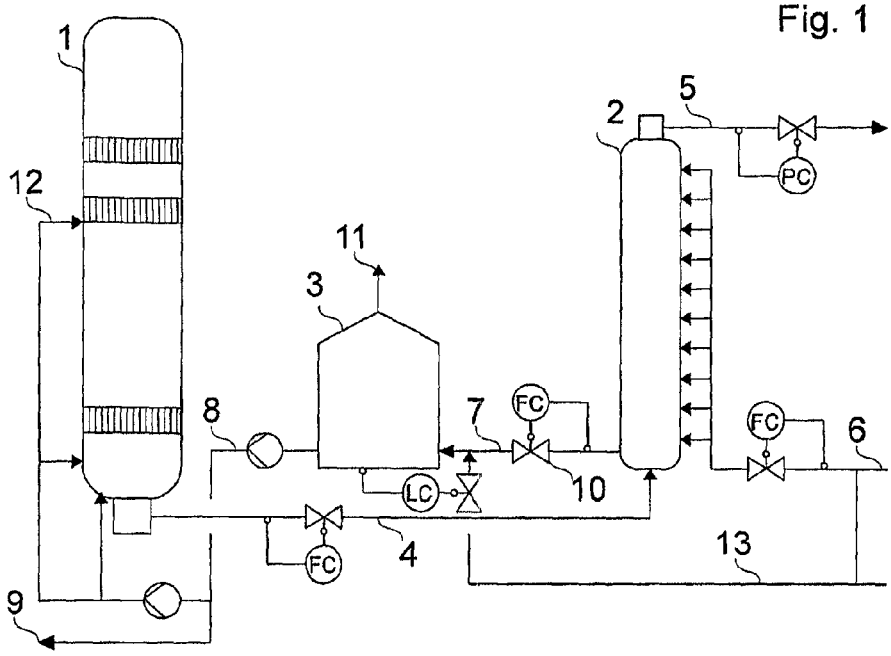
FIG. 1 represents a prior art connection between a continuous digester and a pressure diffuser.

In FIG. 1, a prior art connection between a continuous digester and a pressure diffuser is represented. The pulp flowing from a continuous digester 1 is led into a pressure diffuser 2. The pulp 4 is washed in the pressure diffuser at a pressure of 3 to 6 bar by displacing washing water of a higher purity through a pulp annulus. Most of the liquid from the digester is displaced as a filtrate 7 and most of the washing water is carried on with the washed pulp 5 to the next stage. The removal of filtrate to a non-pressurized filtrate tank 3 is controlled using flow measurement and an adjustable valve 10. In the filtrate tank 3, air and soap possibly trapped in the filtrate are allowed to separate from the filtrate. Air exits through gassing off/gas separation 11, however, soap does not usually exit but it enriches in the filtrate tank 3 until a balance level is achieved. Filtrate 8 is pumped from the filtrate tank 3, part of the filtrate goes to the bottom of the digester 1 where it washes and dilutes the pulp coming out of the digester. Most of the filtrate and soap pumped into the bottom of the digester 1 return with the pulp back to the pressure diffuser 2. Part 12 of the filtrate may also be pumped to other parts of the digester. In addition, a part of the filtrate 8 may be directly led to black liquor transferred to the evaporation plant 9. In this case, a part of the soap is allowed to exit in the circulation between the digester 1 and the pressure diffuser 2. However, most of the filtrate 8 is pumped into the bottom of the digester 1 as only the filtrate pumped into the bottom fully participates in the wash performed in the digester, i.e. the digester wash. The filtrate surface in the filtrate tank 3 is sought to be maintained at the desired level. As the surface level goes down controlled by level control, washing water 13 used in the pressure diffuser 2 is directly taken into the filtrate tank 3. As the surface level rises, the surface level control drives more filtrate past the digester 1 to the black liquor going to the evaporation plant 9. In a solution of prior art, the problem is that soap does not efficiently exit from the circulation between the digester and the pressure diffuser but enriches in it. Using chemicals the solubility of soap is enhanced and a balance level is achieved at a lower soap concentration, in which case problems become smaller. Sometimes soap is separated via overflow from the filtrate tank and the filtrate fraction obtained from the overflow is pumped to the black liquor taken to the evaporation plant. In this case, one is able to separate soap from circulation thus decreasing soap enrichment. In practice, however, the filtrate tank of the pressure diffuser is often too small and soap does not have enough time to separate efficiently. Soap risen to the surface may also easily attribute to clogging as it is carried along from overflow by mere gravity to the pump.

Figure 2:
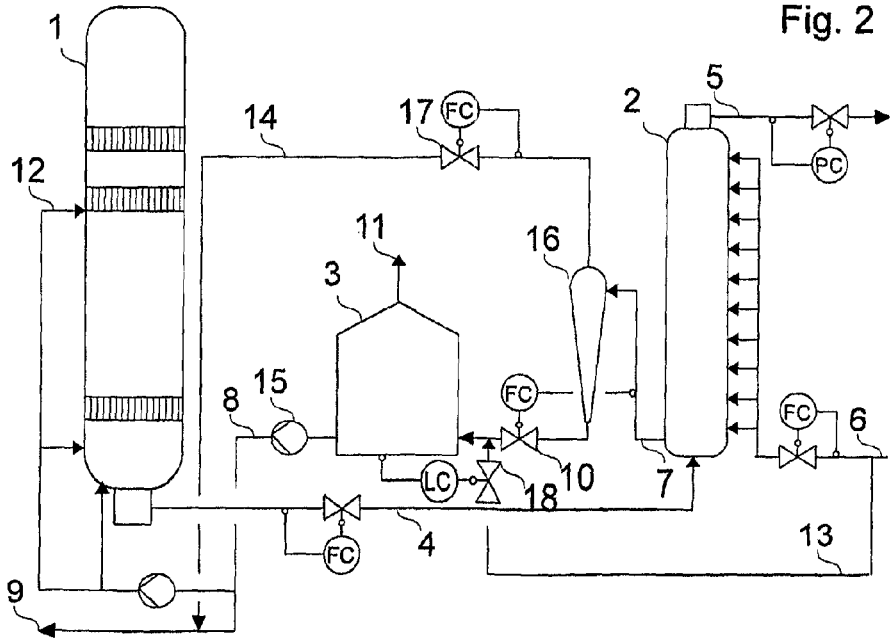
FIG. 2 represents a connection between a digester and a pressure diffuser in accordance with a preferred embodiment of the invention.

In the method according to a preferred embodiment of the invention shown in FIG. 2, filtrate 7 coming from a pressure diffuser 2 is led to a hydrocyclone 16 before taking it to a filtrate tank 3. In the hydrocyclone, light fractions 14, such as soap and air, are efficiently separated from the filtrate 7 as the overflow of the hydrocyclone 16 and pure filtrate obtained as the underflow of the hydrocyclone 16 is taken to the filtrate tank. The separated air and soap fraction 14 is directly taken to the line 9 going to the evaporation plant using the pressure of the pressure diffuser 2 without any clogging problems. Now, the portion of the soap free filtrate 8 that goes into the bottom of the digester 1 displaces soap containing filtrate from the pulp which causes a decrease in the soap concentration of the pulp coming from the digester thus enabling more efficient washing of the pulp in the pressure diffuser. When the soap level of the pulp decreases, the malfunctions caused by soap and air as well as fouling are diminished and the pulp is more efficiently washed in washing apparatus and in the digester. Using the hydrocyclone 16, soap is separated without problems and more efficiently than in a filtrate tank using a traditional method. The soap concentration of filtrates is settled to a lower level and washing apparatus are functioning better. The hydrocyclone 16 utilizes the pressure in the pressure diffuser 2, thus no extra pumping is required. Washing apparatus other than pressure diffuser function at an atmospheric pressure or at only a slight overpressure. In this case, filtrate must be led via the pump to the hydrocyclone to create sufficient pressure and flow. The hydrocyclone functions in this connection arrangement, too, and efficiently removes soap. However, the hydrocyclone causes in any case a pressure loss which has to be compensated for by producing a greater pressure using the pump 15 of the filtrate tank 3. Soap may also be formed on the filtrate in the filtrate tank 3 and this soap formation may cause disturbances. Although the use of the hydrocyclone 16 offers more advantages in connection with the pressure diffuser 2, it can be efficiently used to separate soap and air also in connection with other washing apparatus and their filtrate tanks, provided that the aforementioned requirements are fulfilled.

The filtrate tank of a pressure diffuser has the following tasks: to remove air and soap from filtrate and to act as a buffer tank utilizing surface level changes between the digester and the pressure diffuser. The amount of soap coming from the pressure diffuser usually differs from the amount of filtrate pumped into the digester. The aforementioned filtrate tank surface level control balances the situation. In terms of energy efficiency, a filtrate tank is a very uneconomical solution as the washing water taken to a pressure diffuser is first pumped to a high pressure after which it displaces filtrate in the pressure diffuser, the pressure of which filtrate is "killed" using a valve to the filtrate tank pressure level, i.e. to an atmospheric pressure. After the filtrate tank, the pressure of the filtrate is again increased to a high digester pressure. The hydrocyclone of the invention efficiently removes air and soap from filtrate, i.e. takes care of the first task of the filtrate tank.

Figure 3:
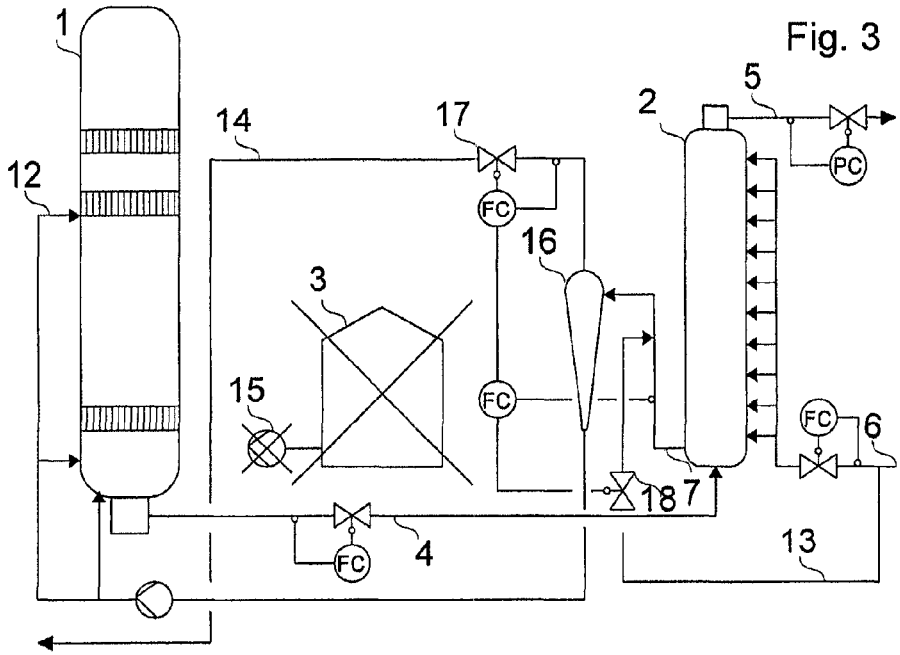
FIG. 3 represents a connection in accordance with another preferred embodiment of the invention and an adjusting model which solves the problem caused by an imbalance of the flows between the digester and the pressure diffuser.

An imbalance between the flows of a digester and a pressure diffuser can be solved using the adjustment model according to a second preferred embodiment of the invention shown in FIG. 3. In this adjustment model, a desired amount of filtrate 8 is driven into a digester 1 and an amount of filtrate 7 that is appropriate for the pressure diffuser 2 is taken away from the pressure diffuser. The amount of filtrate coming from the pressure diffuser 2 is adjusted by using a bypass valve 18 of the pressure diffuser 2 and a bypass valve 17 of the digester. If the digester uses more filtrate 8 than what is desired to take from the pressure diffuser 2, the bypass valve 18 of the pressure diffuser 2 is opened and/or the bypass valve 17 of the digester 1 is constricted to achieve the desired filtrate flow 7 in the pressure diffuser. If the digester 1 uses less filtrate 8 than what is desired to take from the pressure diffuser 2, the bypass valve 17 of the digester is opened and/or the bypass valve 18 of the pressure diffuser is constricted or it is fully closed. With the help of this connection, the filtrate flow 7 of the pressure diffuser is not constricted in any stage using a valve, thus preventing the filtrate pressure from decreasing significantly. With this procedure, to be able to increase the filter pressure to the digester 1 pressure level, considerably less pumping energy is required. In this connection the overflow 14 of the hydrocyclone also acts as the bypass flow of the digester. The bypass flow valve 17 of the digester may be controlled in such a way that a certain minimum flow is taken from the hydrocyclone 16 and this minimum flow can be increased according to the adjustment needs of the filtrate flow of the pressure diffuser 2. The space required by the apparatus is considerably smaller when the filtrate tank is left out. In the inventive connection, the hydrocyclone 16 replaces the filtrate tank, the pump 15 of the filtrate tank as well as the filtrate flow adjusting valve 10 of the pressure diffuser (see FIGS. 1 and 2) to achieve a simpler, more compact and more energy efficient solution than in prior art. The essential part of this solution is that the removal of soap and air is performed in a pressurized apparatus and that the pressure of filtrate fed to the next washing stage is not decreased as it exits from the pressure diffuser.

Figure 4:
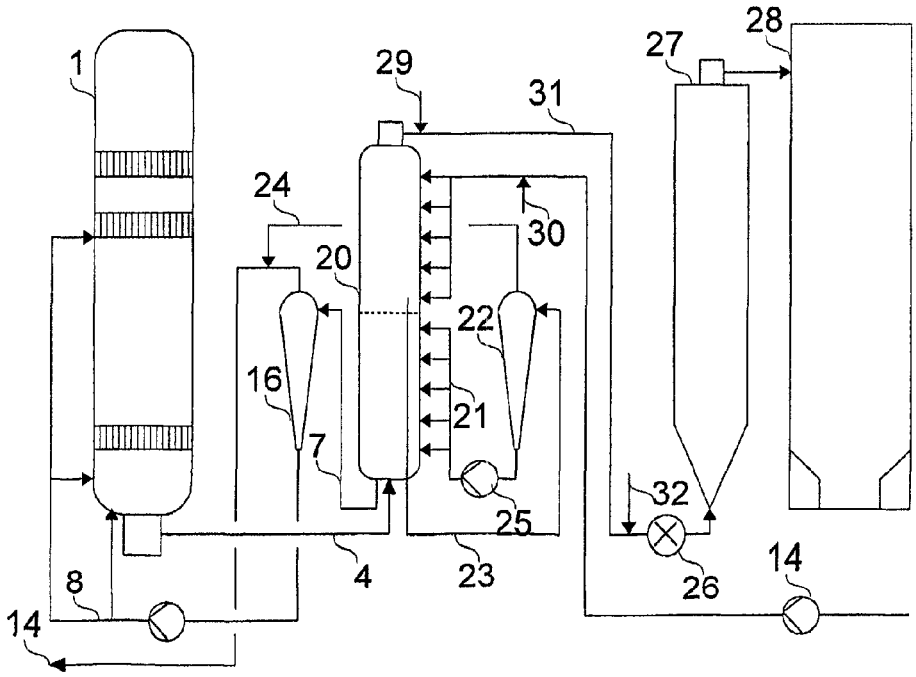
FIG. 4 represents a connection of hydrocyclones in connection with a two-stage pressure diffuser in accordance with a third preferred embodiment of the invention.

In many washing apparatus, such as an atmospheric diffuser or a DD washer, there may be more than one washing stage in a single washing apparatus. However, no two-stage pressure diffusers have been manufactured. One reason for not manufacturing a two-stage pressure diffuser is that between the stages the pressure of the filtrate would have to be decreased to the level of a filtrate tank, i.e. to an atmospheric pressure, and then again increased to the pressure level of the pressure diffuser. Such a procedure significantly decreases the energy efficiency of a two-stage pressure diffuser. In a solution according to a third preferred embodiment of the invention, this pressure decrease is avoided thus increasing the energy efficiency of a two-stage diffuser. FIG. 4 represents the connection of hydrocyclones in connection with a two-stage pressure diffuser 20. In the direction of motion of pulp, filtrate 7 of the first washing stage is divided in a hydrocyclone 16 to an underflow and an overflow, the underflow is taken to a digester 1 and the overflow past the digester 1 to black liquor taken to an evaporation plant 14. Washing water 21 of the first stage of the pressure diffuser 20 is the filtrate 23 of its second washing stage that has been purified using a second hydrocyclone 22. Because soap is efficiently removed from the filtrate 7 of the first washing stage using the hydrocyclone 16, filtrate of the second washing stage is quite pure and thus only a very small overflow 24 must be taken from the hydrocyclone 22 of the second washing stage to the evaporation plant, or the hydrocyclone 22 of the second washing stage can even be completely left out. The amount of filtrate flow of the second washing stage and the flow amount of washing water of the first washing stage is adjusted using a pump 25 and an adjustable valve. The head requirement of the pump 25 is small. The pump 25 is only needed to overcome pressure losses of the flow between the first and second washing stages. The filtrate of the next washing apparatus is used as the washing water 30 of the second washing stage. Pressure diffuser 20 has the advantage over other washing apparatus that the pressure of pulp is maintained at a high level throughout the washing stage. This enables, among other things, performing washing of the pulp in the pressure diffuser 20 at a temperature clearly over 100° C. At a higher temperature, the washing and displacing procedure is more efficient due to the lower viscosity of liquids. In practice, however, temperatures of over 100° C. have not been reached because in prior art solutions filtrate expands in an atmospheric filtrate tank to the level of 100° C. In a filtrate tank the drastic expansion of filtrate leads to foam formation and smell releases. For this reason, filtrates are usually cooled so that the temperature is maintained at under 100° C. In the solution of the present invention not containing a filtrate tank, filtrate is maintained pressurized throughout and prevented from expanding even if the temperature was clearly over 100° C. This enables a better washing efficiency and energy efficiency for the process. In this case, cooling of filtrates between the digester and the pressure diffuser is not needed and the condenser used for this purpose in prior art is not required.

When soap is removed from the brown stock washing, the efficiency of washers is increased. Similarly, an increase in the temperature of the pressure diffuser increases the washing efficiency. Considering these, a two-stage pressure diffuser can be used to wash the pulp pure enough for the oxygen stage. This enables the extremely compact connection of the brown stock washing and the oxygen stage as shown in FIG. 4. The pulp flows at the digester 1 pressure through a two-stage pressure diffuser 20 in which the pulp is washed pure enough for the oxygen stage. From the pressure diffuser 20 the pulp is directly led in a pulp pipe 31, without reducing pressure, to a mixer or an MC pump 26 which mixes the chemicals 32 of the oxygen stage and, if required, increases the pressure of the pulp. Subsequently, the pulp still flows directly into an oxygen reactor 27 which allows for a sufficient retention time for the reactions of the oxygen stage. Oxygen stage can also be performed in two or more separate reactors, which is quite usual nowadays. In the case of two (or more) reactors, pressure losses of pulp flow increase and it is often required to increase the pressure using an MC pump 26. On the top of the reactor 27 there is a reactor pressure adjusting valve in which the pressure of the pulp is decreased to an atmospheric level. From the valve, the pulp flows into a pulp tank 28 in which the vent gases of the oxygen stage are allowed to exit. To decrease the pressure losses in the piping, the alkali 29 required in the oxygen stage may be fed, immediately after the pressure diffuser, to the pulp, or alternatively even to the washing water 30 fed into the pressure diffuser. The alkali rich pulp slides more easily in the pulp pipe 31 thus decreasing pressure losses. Oxygen and steam 32 required in the oxygen stage are fed onto the front side of the mixer/MC pump. Because the pressure diffuser can be operated even at a temperature of over 100° C., the required extra heating with steam is minimal. The required pulp heating may also be performed by heating with indirect steam the washing water 31 fed into the pressure diffuser in a heat exchanger 30. In this case, condensate is not in place to dilute the pulp, as in prior art solutions, but condensate can be recovered. In addition to alkali, oxygen can also be fed into the washing water fed into the pressure diffuser. Thus, favourable conditions for the reactions of the oxygen stage can be created already in the pressure diffuser and at the same time the pressure diffuser acts as the first oxygen reactor. After the oxygen stage, knots and rejects are removed from the pulp after which it is washed and bleached. This connection also offers the advantage that the whole fibre line only needs a single pulp storage tank. In solutions of prior art, traditionally there has been a pulp storage tank both after cooking and in the feeding of bleaching.

Although a two-stage pressure diffuser was mentioned above, it can naturally be replaced by two or more single-stage pressure diffusers. It is essential that there are at least two washing stages after the digester wash to achieve an adequate purity level. In fact, in terms of piping connections, it would be rather preferable to use a solution where there are two pressure diffusers, in the first one of which pulp flows upwards and in the second one downwards. With such a connection, the amount of piping between apparatus is decreased and thus the pressure loss of pulp flow in the piping is decreased as well as the need for increasing the pressure of pulp before an oxygen reactor. There are several advantages when using indirect steam in the oxygen stage. Condensate is recovered and is not left to dilute the pulp. The condensate mixing with the pulp is carried along via a washing connection to an evaporation plant and burdens the evaporation plant or causes a need for decreasing the dilution factor in the wash after the oxygen stage. When heating with indirect steam, the pressure requirement for the used steam is determined only based on temperature, not on the pressure of the pulp pipe, as is the case in prior art solution when using indirect steam. In a two-stage oxygen stage, there are typically great pressure losses in the pulp pipe between reactors and the pressure of the pulp pipe is high, typically approximately 10 bar, at the spot where the heating steam is brought to. Naturally, the pressure of the fed steam must be higher than the pressure of the pulp pipe. For this reason, the pressure of intermediate pressure steam led from a turbine of a power plant of a pulp mill to a fibre line is typically determined by the oxygen requirement in the oxygen stage. When use of direct steam in the oxygen stage can be given up, the pressure of intermediate pressure steam led to the fibre line can be decreased thus increasing turbine efficiency.

Considering the above mentioned advantages, it can be seen that a pressure diffuser is exceptionally, well suitable as a washing apparatus before the oxygen stage. The above described advantages are achieved when an oxygen stage is directly connected after a pressure diffuser. In terms of the advantages of the oxygen stage, the type of the process connection before the pressure diffuser is not significant. Before the pressure diffuser, there may even be a batch cooking department or other washing apparatus in which the pressure of pulp is decreased to an atmospheric level. To minimize the pumping of pulp, an ideal solution is described in FIG. 4 where a digester's pressure drives the pulp through washing and oxygen stages. Naturally, pumping of pulp is preferably minimized to save energy. Another significant factor is that in an MC pump the fibres of pulp undergo a great deal of mechanical processing at a relatively high temperature. This processing may break fibres and weaken the tensile properties of pulp.

As mentioned above, in contrast to other washers, in a pressure diffuser the pulp is kept pressurized throughout. For this reason, no air gets into pulp or filtrates in a pressure diffuser as is more or less not the case when using other washers. If the amount of soap is small, for example, in the case of hardwood pulp or thanks to a good digester wash, filtrates of a pressure diffuser may be directly led to the next stage without separating soap or air in a filtrate tank or in a pressurized apparatus according to the invention. Accordingly, the above and in FIG. 4 described solutions for digesting, washing and oxygen stages may also be performed completely without any soap and air separation steps.

Figure 5:
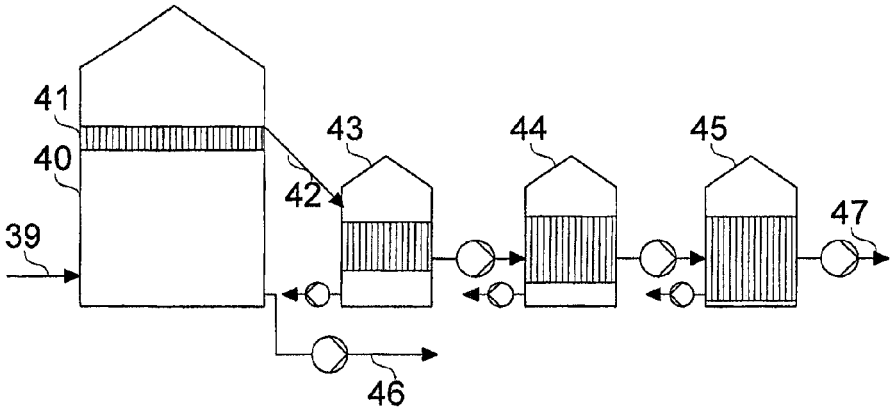
FIG. 5 represents a prior art way of separating soap from black liquor before leading black liquor to evaporation units.

From the fibre line, soap is carried along with black liquor to an evaporation plant in which it is sought to be separated as well as possible before leading black liquor into evaporation units. In a prior art solution in FIG. 5, separation takes place in the black liquor tanks 40 in the inlet of the evaporation plant in which tanks soap carried along with the black liquor 39 of the fibre line rises up to the surface. The black liquor 46 lean in soap is pumped from the bottom of the inlet black liquor tank 40 to evaporation units. Soap 41 is peeled off from the surface of black liquor via overflow 42 to another tank 43. At least sometimes, considerable amount of black liquor flows away with soap. Black liquor and soap are separated in a similar way further with 2 to 4 series-connected tanks 43, 44 and 45 before the soap 47 is obtained in a sufficiently pure form for tall oil digesting. In these tanks 43 to 45, black liquor falls onto the bottom from where it is pumped up and after an appropriate processing taken to be evaporated in evaporation units. The soap layer is in all tanks 40, 43 and 44 higher than black liquor and soap is pumped from the layer to the next tank. As can been seen from FIG. 5, a prior art solution is rather complicated and expensive with its several tanks and pumps. Soap 41 separation from the inlet black liquor tank 40 requires that the retention time in the tank 40 is sufficient. For this reason, inlet black liquor tanks are very large and their surface level must be kept high all the time. Although the tank has a large volume, by changing the surface level one is able adapt to the variations of fibre line and evaporation plant production levels, but only slightly. If the production level of the digesting department changes for some reason, the production of the evaporation plant must also change quite quickly. If the surface level of the inlet black liquor tank rises too high, black liquor flows via overflow to the tank 43. If the surface level drops too low, soap separation is weakened and soap gets into evaporation units causing serious problems.

Figure 6:
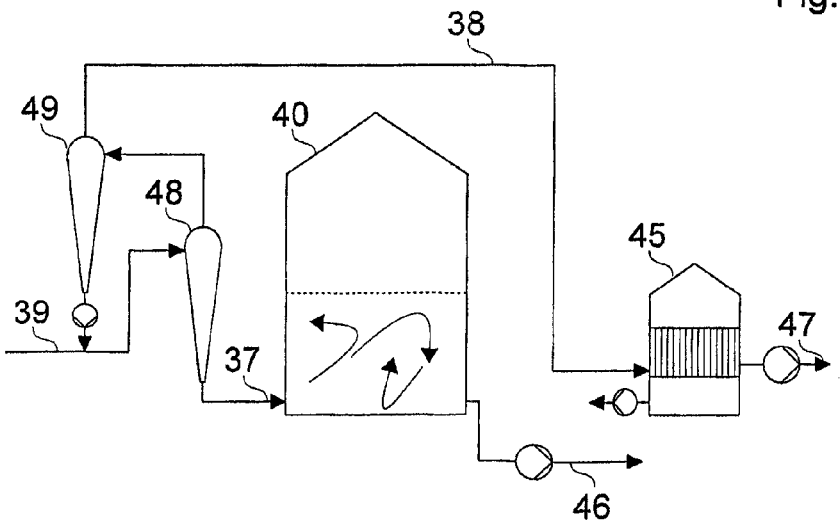
FIG. 6 represents a way of separating soap from black liquor before leading black liquor to evaporation units in accordance with a fourth preferred embodiment of the invention.

In the method according to a fourth preferred embodiment of the invention represented by FIG. 6, soap is separated from black liquor using one 48 or more hydrocyclones 49 before leading black liquor into an inlet black liquor tank 40. Black liquor 37 purified with the hydrocyclone/-cyclones 48, 49 is so pure that it may be taken into evaporation units without any extra purification. In other words, in practice the black liquor tank 40 in question may be clearly smaller than before because it does not have to act as a soap separation apparatus. Even small soap concentrations may little by little separate from the inlet black liquor tank 40 onto the surface of black liquor as a separate layer. If this layer, due to changes in surface level, gets into the evaporation unit, it causes problem within it. In the solution according to the invention, black liquor is fed into the tank 40 in such a way that it mixes as efficiently as possible and that no soap layer is able to form on the surface. In prior art solutions, the situation is reversed and mixing is sought to be prevented in every way to maximize separation. Soap 38 may, in the present invention, be purified in several hydrocyclone steps to such a purity level that it may be fed to tall oil digesting 47 from its storage tank 45. In place of a single hydrocyclone, one may also use an apparatus where there are several parallel small hydrocyclones. Such an apparatus achieves an outstanding separation efficiency and even a single step may yield soap that is, as such, pure enough for tall oil digesting. The solution of the invention greatly simplifies the soap separation process of an evaporation plant.

Black liquor coming from a digester is usually at a temperature of 140 to 170° C. Before evaporation, traditionally black liquor has had to be cooled down to a temperature below 100° C. since soap separation and storage have taken place at an atmospheric pressure. A hydrocyclone enables soap separation at a temperature clearly above 100° C. In this case, black liquor may be taken past an inlet black liquor tank directly to evaporation steps or to some kind of a pre-evaporation plant at a temperature above 100° C. thus yielding clearly better energy efficiency at the evaporation plant. Numerous solutions for enhancing steam economy at evaporation plants have been developed where the heat generated by hot digesting black liquor is utilized in evaporation. However, they have not gained more popularity as most often their problem has been that soap rich black liquor undergoes foam formation and causes fouling and clogging problems. When soap is removed from hot black liquor using a hydrocyclone, the foam formation problems are avoided and the hot black liquor can be directly taken from a digesting department to an evaporation unit.

Figure 7:
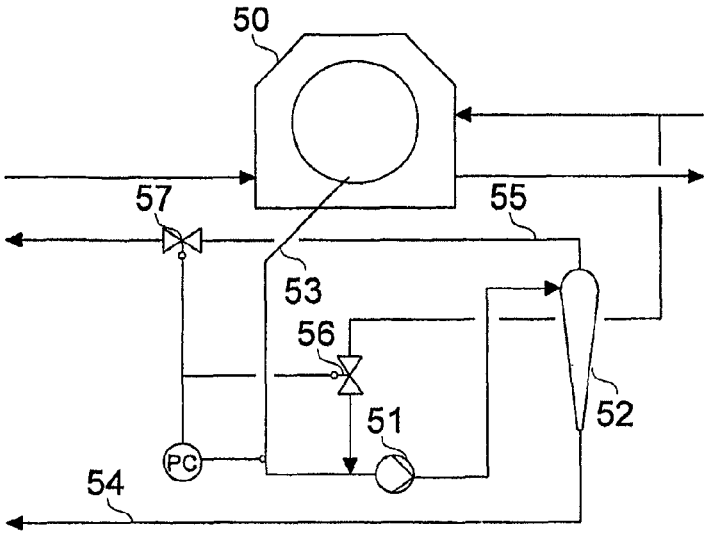
FIG. 7 represents separation of soap using a hydrocyclone in accordance with a fifth preferred embodiment of the invention and in a situation where pulp is washed with a so-called DrumDisplacer™ washer.

It is also to be noted, in terms of the above described filtrate handling at a washing department, that although the invention has been described for use in connection with a pressure diffuser, the above described method can also be naturally used in connection with other types of washers. It is essential that the filtrate coming from a washer has the required pressure to overcome pressure losses in a hydrocyclone. If required, the pressure of filtrate may be increased using a pump. For example, a DD washer (DrumDisplacer™ washer) functions at a slight overpressure. Referring to FIG. 7, the filtrate 53 pressure of a DD washer 50 may be increased using a pump 51 and filtrate can be fed to a hydrocyclone 52. In the hydrocyclone, the filtrate is divided to pure underflow 54 as well as to overflow 55 containing soap and air. Solutions presented above in connection with a pressure diffuser may also be used for a DD washer. DD washer can function without a filtrate tank, too. In prior art solutions, the filtrate flow of a pressure diffuser is adjusted with a valve, however, with a DD washer as much of the filtrate is taken out as whenever comes out. The filtrate coming out flows freely into a filtrate tank. In a solution according to the invention, the amount of filtrate that can be taken out of a DD washer is represented by the pressure on the suction side of the pump 51. If the pressure rises from a reference value, there would be more filtrate for use than what is used. However, if the pressure decreases from a reference value, there would be less filtrate for use than what is obtained. Since the pressure on the suction side of the pump 51 may be rather low, it is preferable to use a pump the NPSH value (Net Positive Suction Head) of which is low. When using a DD washer, the filtrate pressure control controls adjustable valves in the same way as the filtrate flow control when using a pressure diffuser. If the pressure of filtrate declines, the bypass valve 56 of the DD washer is opened or the overflow fraction valve 57 is constricted. Similarly, if pressure rises, the overflow valve 57 is opened and the DD washer bypass valve 56 is constricted. In other words, DD washer may also be operated without a filtrate tank, as above described in connection with a pressure diffuser. If the filtrate of a DD washer is reasonably soap and air free, one may operate both without a filtrate tank and without a hydrocyclone. In this case, the pressure of filtrate is adjusted based on the above described principle using a DD washer bypass valve and a valve on the suction side of the pump.

Figure 8A:
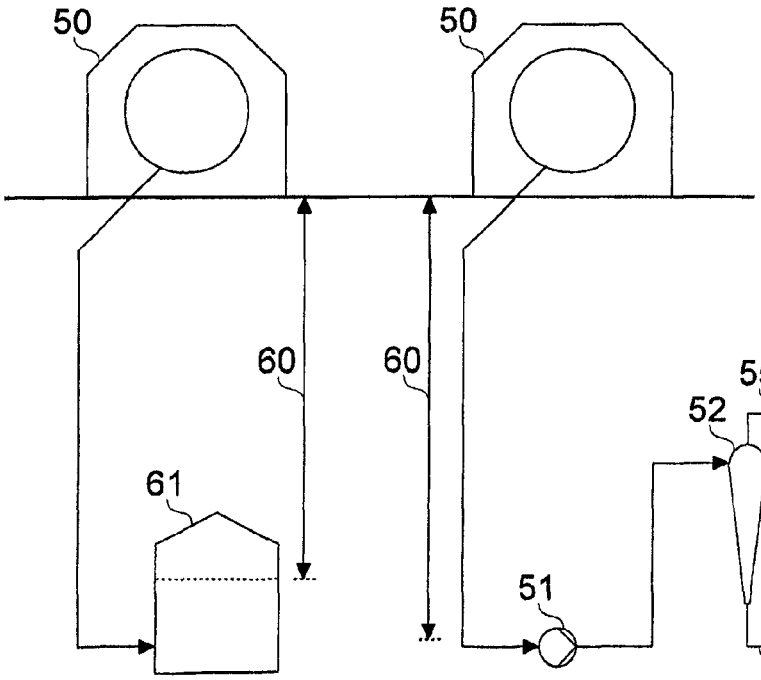
FIGS. 8*a* and 8*b* represent filtrate connections of a DrumDisplacer™ washer utilizing a suction leg in accordance with prior art, and with a sixth preferred embodiment of the invention.

In prior art solutions of FIG. 8*a*, DD washers may be located even 10 meters from ground level to provide a sufficient suction leg. Large and heavy DD washers 50 require strong and expensive support structures when being that high. The surface level of filtrate in a filtrate tank 61 is typically 2 to 6 meters above ground level. The higher the surface level of filtrate in the filtrate tank 61, the smaller is the effective suction leg 60. On the other hand, the lower the level of the filtrate tank 61 (short separation time), the weaker is soap and air separation from the filtrate.

Figure 8B:
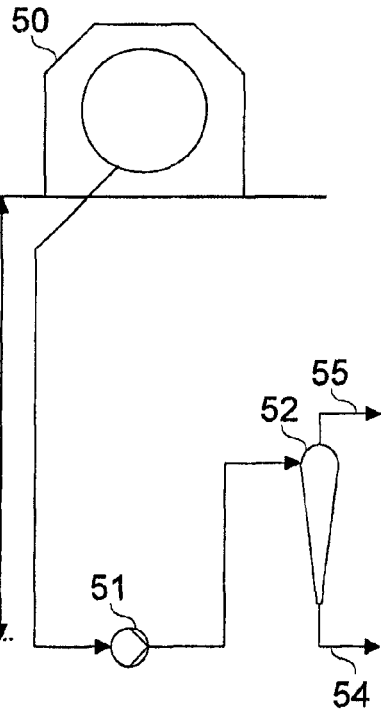

In the solution according to the invention, in FIG. 8*b*, the pressure level on the suction side of a pump 51 may be close to atmospheric pressure. In this case, considering the suction leg of a DD washer, the situation is similar to one where the surface level of filtrate tank was on the same level. In other words, the solution of the invention achieves the same suction leg efficiency as with the filtrate tank solution even if DD washer was 2 to 6 m lower. Placing DD washer 2 to 6 m lower would yield considerable savings in construction costs. Also, filtrates of washing presses may easily be processed as shown in FIGS. 7 and 8*b*. When using traditional filters, considerable amounts of air may be mixed within filtrate. Removing a large volume of air would require a large overflow and a tank from which to recover the filtrate carried along with the overflow. When processing moderately pure filtrates, the amount of overflow may be kept small and the overflow may be taken out of the process to an evaporation plant or to waste waters of a bleaching line or to some other destination. In the pure end of brown stock washing, small amounts of overflow can also be taken to waste waters without significant chemical losses or waste water load. At the area of bleaching, if required, even larger overflows can be taken to waste waters because that is where the filtrates end in any case in some point. It is worth noting that in an atmospheric diffuser filtrate flow is not even. Filtrate flow cuts off in connection with the descent of the sieve of the diffuser. However, a hydrocyclone functions even if its flow cuts off at times. An uneven filtrate flow, however, makes it more difficult to connect an atmospheric diffuser directly to other washers which is why such a tank that receives the changes in filtrate flow may be needed.

Figure 9:
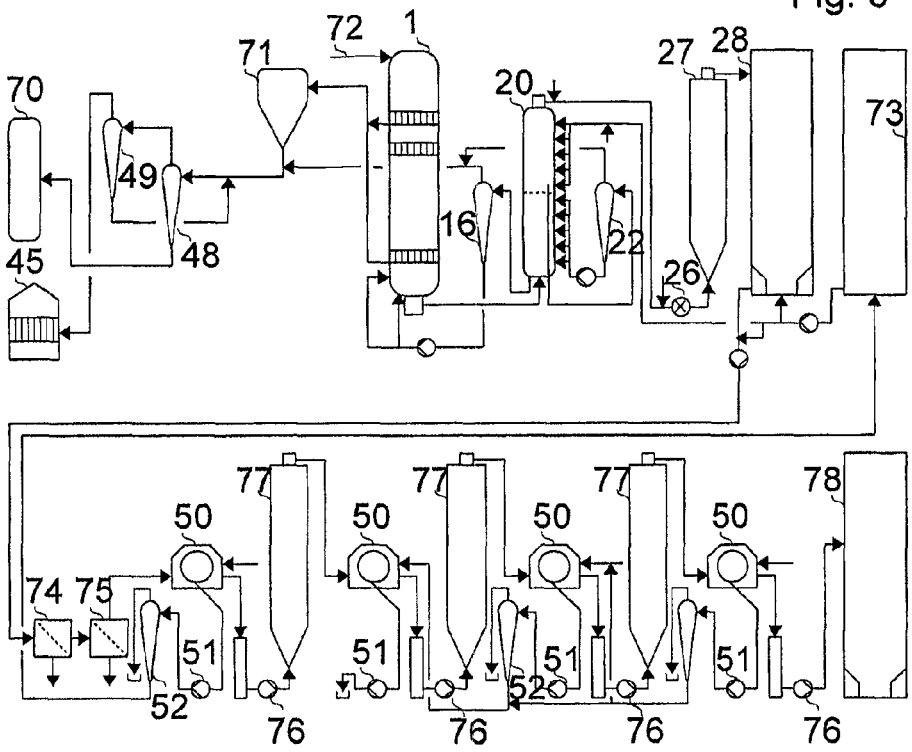
FIG. 9 represents a fibre line and an evaporation plant connections in accordance with a seventh preferred embodiment of the invention.

FIG. 9 represents some of the connections of a fibre line and an evaporation plant according to a sixth preferred embodiment of the invention. Woodchips 72 are fed into a continuous digester 1 in which it is digested to a pulp. Instead of a continuous digester, woodchips may be digested using a batch digesting department, too. Pulp is blown into a two-stage pressure diffuser 20 in which it is washed. On the place of a single two-stage pressure diffuser 20 there could be two single-stage diffusers or any other washers that achieve the desired washing result. Filtrates of the pressure diffuser 20, more broadly, of a washing apparatus, are processed with hydrocyclones 16 and 22 wherein filtrates are divided in two parts, overflows containing air and soap and underflows containing filtrate of higher purity. The purified filtrate is taken to the preceding washing stage, in accordance with all the principles of countercurrent washing. Soap and air are sought to be removed from a fibre line by taking them to the black liquor going to an evaporation plant. Soap and air could also be directly taken to an evaporation plant for further processing. The black liquor obtained from a digesting department typically consisting of material dissolved from wood, woodchip water, white liquor and filtrates obtained from brown stock washing is expanded in an expansion tank 71 in which the pressure of black liquor decreases and part of it turns into steam. The overflow fraction of hydrocyclones 16 and 22 is often desirable to feed to black liquor after the expansion tank 71 because the pressure of black liquor is lower at this point and soap could cause foam formation in the expansion tank 71. Fibres among black liquor are removed before taking the black liquor to an evaporation plant 70. As there are no fibres in the soap fraction it is recommended to feed it to black liquor before the above mentioned fibre removal. If there is not a too large volume of fibres and the soap separated from filtrates is pure, the soap fraction may be directly taken to the evaporation plant 70 for further processing. From the expansion tank 71, expansion steam is obtained and utilized directly or indirectly in the air removal of the woodchips 72 taken to digesting 15. From the expansion tank 71 only such an amount of steam is taken that is needed in air removal. In prior art solutions, black liquor is expanded and cooled in such a way that it is pumped to an evaporation plant at a temperature of 85 to 95° C. In the solution of the invention, black liquor may be taken to an evaporation plant at a temperature of approximately 90 to 150° C., more preferably at a temperature of 105 to 150° C. At the evaporation plant, black liquor is processed using one or more hydrocyclones 48 and 49 in such way that black liquor and soap are obtained, the soap concentration of which black liquor is low enough to enable taking black liquor to evaporation units 70 and the purity of which soap is high enough to enable taking it to a tall oil digesting inlet tank 45. At least a part of the purified black liquor is directly taken at a temperature above 100° C. to an appropriate evaporation unit 70 where the high temperature of black liquor can be utilized to improve the steam economy of the evaporation plant. Black liquor can also be allowed to expand in a separate expansion tank from which expansion steam is obtained and led to evaporation units. Part of the black liquor can be, for example, taken through a condenser to a black liquor tank because, in this case, as the flow of the black liquor coming from a digesting department fluctuates the inlet flow to evaporation units does not have to fluctuate at the same pace. Also, the soap fraction can be cooled using a cooler or allowed to expand to an appropriate temperature before leading it to a tall oil inlet tank 45.

The pulp washed in the pressure diffuser 20 is directly led to an oxygen reactor 27 without decreasing pulp pressure to an atmospheric level. In the oxygen reactor 27, or alternatively in two or more series connected oxygen reactors, lignin left in the pulp is dissolved by exposure to alkali and oxygen. A part of alkali and oxygen may be fed to the washing water of the second washing stage of the pressure diffuser 20. In this case, the reactions of oxygen stage start to take place already in the pressure diffuser wherein the pressure diffuser 20 and the pulp pipe after it act as the first reactor of a two- or more-stage oxygen stage. Utilizing the same principle, the first step of the oxygen stage may also be implemented in an atmospheric diffuser where there is also sufficient delay for reactions. Washing water is fed into a pressure diffuser 20 through several nozzles thus moderately mixing chemicals in the pulp even if an actual mixer is not used. The second step of the oxygen stage starts with a mixer 26 and takes place in the actual reactor 27. From the oxygen reactor 27, the pulp is led into a pulp tank 28 in which the residual gases of the oxygen stage are allowed to exit from the pulp. The pulp tank 28 also works as a buffer tank between process stages preceding and following it. The pulp leaving from the pulp tank 28 is diluted to an appropriate consistency, typically to approximately 3% to 6%, for knot separation 74 and sorting 75. In knot separation 74 and sorting 75, the undigested fraction and other impurities are removed from the pulp. These fractions can be led to preceding process stages, for example, to digesting, or they can be completely left out of the process. After sorting the pulp is led, through an optional pre-thickener, to a DD washer 50 in which it is washed pure enough for bleaching. In the DD washer 50 the consistency of pulp raises to a high enough level for the bleaching. In place of the DD washer 50, there may be some other washer, such as a press or a filter washer, using which the pulp may be purified pure and consistent (8% to 15%) enough for bleaching. Pressure and atmospheric diffusers work badly with a dilute pulp and cannot thicken pulp as much as other washers, which is why they are not very suitable for this application. The filtrate of the DD washer 50 is led to a pump 51 below the washer which pumps the filtrate through a hydrocyclone 52 to a filtrate tank 73. The DD washer 50 does not require a traditional filtrate tank but the low pressure maintained on the suction side of the pump 51 creates a good enough suction leg and the hydrocyclone 52 removes air and other light impurities from the filtrate through overflow. A small overflow may be led to a canal because, after the oxygen stage, filtrates are already moderately pure and no significant chemical or other losses occur. If required, the overflow may also be led somewhere else, for example, to a pulp tank 28 in which case no releases occur. The filtrate tank 73 is not the filtrate tank for the DD washer but a filtrate storage tank which compensates for the surface level fluctuations of the pulp storage tank. When pulp consistency is at 10%, it contains 10% of dry pulp and 90% of filtrate. As the surface level of the pulp tank 28 rises, filtrate is stored to the pulp tank 28 leading to a surface level decrease in the filtrate tank 73. As the surface level of the pulp tank 28 drops, filtrate in the pulp is released and the surface level of the filtrate tank 73 rises. In terms of the uniformity of the washing result, it is essential to maintain the total filtrate amount in the pulp tank 28 and filtrate tank 73 at an even level; also, it is important that the filtrate tank 73 has a high enough volume to compensate for the surface level fluctuations of the pulp tank 28. From the DD washer 50, pulp is led to an MC pump 76 which is used to pump the pulp through a chemical mixer into a first bleaching reactor 77. Bleaching may, be performed in approximately 2 to 5 stages using chloride dioxide, NaOH and/or other suitable bleaching chemicals. From the bleaching reactor 77, the pulp is led either directly or through a separate dropleg and an MC pump to the next DD washer 50. To ensure fluent flowing of the pulp going to the washer 50, a small amount of filtrate can be led to the beginning of the pipe leaving from the reactor. This filtrate dilutes the pulp and decreases the friction caused by the flow. Preferably, the diluting filtrate is fed in such a way that it dilutes only the pulp at the circumference of the pipe in which case the average consistency of the pulp is only slightly decreased but the friction lowering impact is high. From the DD washer, the pulp is led to an MC pump which pumps it to the next bleaching stage. The filtrate of the DD washer is taken to the pump which creates a good enough suction leg for the DD washer. Waste waters of bleaching are typically led through canals to a waste water processing plant, therefore the waste waters of the first bleaching stage can be pumped to the canal or some other appropriate target. The following bleaching stages function similarly. The pulp is pumped into the reactor 77 from which it is further led to the DD washer 50. From the washer, the pulp continues to the MC pump of the next stage and the filtrate to pump 51. The filtrates of the latter stages of the bleaching process can be utilized as washing waters of previous stages for minimizing the amount of waste waters. It is preferable to remove air from these circulated filtrates by means of a hydrocyclone 52. The underflow of the hydrocyclone 52 is taken as washing water and the overflow through a canal to a waste water processing plant. At the end of the bleaching process, the pulp is pumped into a bleached pulp storage tank 78. In the described solution, DD washers are used as washers of the bleaching process. Other washers could as well be used as washers, such as presses or pressure diffusers.

Figure 10:
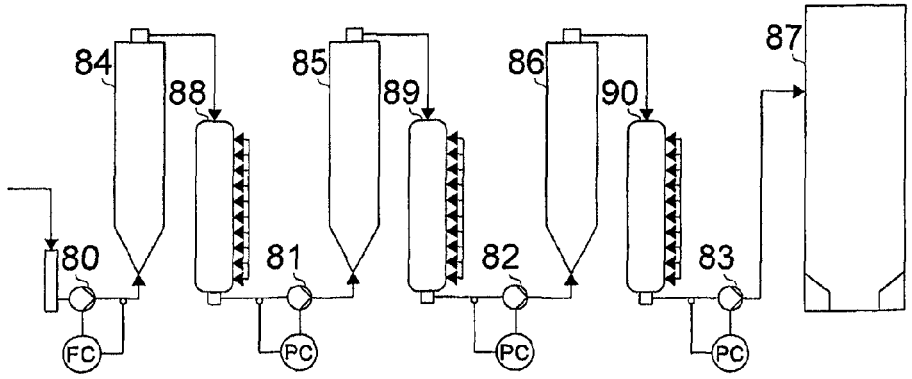
FIG. 10 further represents bleaching plant connections in accordance with an eighth preferred embodiment of the invention wherein washing is performed using pressure diffusers.

A bleaching plant where the washers are pressure diffusers would offer an opportunity to simplify the process in a similar way as has been described in connection with a digester and an oxygen stage. After the reactor the pulp is led to a pressure diffuser and from there to a following MC pump without decreasing the pressure with an adjustable valve. Thus, the MC pump already has suction pressure and the pump needs to increase the pressure considerably less. MC pumps rotate at a slower speed and their electrical power intake is smaller. At the same time, the mechanical stress that weakens the fibres of the pulp is decreased. FIG. 10 represents a pressure diffuser bleaching plant according to a seventh preferred embodiment of the invention as well as a solution to control its pulp pumping. The speed of rotation of the first MC pump 80 adjusts the amount of pulp fed into the bleaching process either by a flow control or a surface level control of the dropleg of the MC pump. The rotational speeds of the following MC pumps 81, 82, 83 adjust the pressure on their suctions sides. In this case, each pump delivers forward the amount of pulp delivered to them. If the pressure on the suction side increases, the rotational speed increases and the amount of pulp taken forward becomes larger. Using this arrangement, one is able to pump pulp evenly forward and the pressure level of each stage in the reactors 84, 85, 86 is maintained at the desired level. At the area of the whole bleaching process, the pulp flow need not to be constricted with any adjustable valves, thus the total power requirement of pumping remains at a lower level than in prior art. It is preferred to use the pressure diffusers 88, 89, 90 in which pulp flows from top to down. In this case, the pulp pipe from the reactor top to the feed of the pressure diffuser and from the pressure diffuser to the MC pump is shorter. Pressure diffusers in which pulp flows from down to up are also suitable but their connection requires longer pulp pipes.

As may been seen in light of the above discussion, such a novel method and an apparatus for separating soap and air from filtrates of wood processing industry has been developed that fundamentally simplifies and intensifies the processes of this industry. At the same time, however, it is to be noted that the method of the invention may also be used in many other applications where there are soap containing filtrates or black liquors. As examples of such it may be mentioned, among other things, connections of a continuous digester and other washers than a pressure diffuser as well as connections between a batch digesting department and various washers, which thus include both various presses and various washers utilizing a suction leg or a similar sub-atmospheric pressure developing apparatus.

The invention claimed is:

1. A method of processing cellulose pulp of wood comprising:

producing pulp by digesting softwood or hardwood chips in a pressurized digesting vessel;

washing the digested pulp;

bleaching the washed pulp in an oxygen stage; and from filtrate discharged from the washing step, separating at least one of soap, gas and other light materials in a pressurized separation device, wherein the separation in the pressurized separation device occurs at a pressure above atmospheric pressure;

wherein the washing step uses a pressure diffuser to wash the digested pulp and the filtrate received by the pressurized separation device is received from the pressure diffuser and wherein the filtrate remains under a pressure above atmospheric pressure while flowing from the washing step to the pressurized separation device.

2. The method according to claim 1, further comprising a second washing step in which the washed digested pulp is washed in a second pressure diffuser.

3. The method according to claim 1, wherein the washing step includes feeding wash water to the pressure diffuser which feeding causes the filtrate to be displaced from the pressure diffuser.

4. The method according to claim 3 wherein the filtrate from the pressure diffuser flows into a pressurized separation apparatus which discharges an essentially soap-free fraction of the filtrate, wherein the filtrate and the essentially soap-free fraction are maintained at a pressure substantially greater than atmospheric pressure.

5. The method according to claim 4 further comprising feeding the essentially soap-free filtrate to the digester vessel, and adjusting a rate of filtrate flowing from the pressure diffuser using a bypass valve in the pressure diffuser and a bypass valve in the digester vessel.

6. The method according to claim 5, further comprising at least one of opening the bypass valve of the pressure diffuser and constricting the bypass valve of the digester vessel to reduce the rate of filtrate flow from the pressure diffuser.

7. The method according to claim 5 further comprising opening the bypass valve of the digester vessel or constricting the bypass valve of the pressure diffuser to increase the rate of filtrate flow from the pressure diffuser.

8. The method according to claim 2, wherein the second pressure diffuser includes at least one of a high consistency pulp pump (MC pump), a bleaching reactor, and a pressure diffuser.

9. The method according to claim 8, further comprising adjusting a rotational speed of a first high consistency pump, using flow control or based on the surface level of the dropleg of the pump and adjusting the rotational speed of each following high consistency pulp pump as a function of the inlet pressure of the pump.

10. The method according to claim 1, wherein filtrate discharged from the pressurized separation device is essentially free of soap.

11. The method according to claim 10, wherein the filtrate discharged from the pressurized separation device flows as washing liquid to another washing step.

12. The method according to claim 10, wherein the filtrate discharged from the pressurized separation device flows as liquor into the pressurized digesting vessel, and wherein the filtrate discharged from the pressurized separation device remains under a pressure above atmospheric pressure while flowing from the pressurized separation device to the pressurized digesting vessel.

13. The method according to claim 1, further comprising transporting the at least one of soap, gas and other light materials directly to an evaporation plant or into black liquor going to the evaporation plant.

14. The method according to claim 1, wherein the washing includes washing the digested pulp in a two-stage pressure diffuser.

15. The method according to claim 14, wherein the washing step includes feeding wash water to the two-stage pressure diffuser, the feeding of wash water displaces the filtrate from a second stage of the pressure diffuser and the method further comprises separating said displaced filtrate into an essentially soap-free fraction which is fed as the wash water to a first stage of the two-stage pressure diffuser.

16. The method according to claim 15 wherein the filtrate is at a temperature above 100° C. after being discharged from the second stage and the method further comprises processing the filtrate in a pressurized separation apparatus at a temperature above 100° C. and feeding the essentially soap-free faction to the second stage which is at a temperature above 100° C.

17. The method according to claim 14 further comprising feeding the washed pulp from the two-stage pressure diffuser directly to the oxygen stage without passing the washed pulp through a separate tank.

18. The method according to claim 17, further comprising feeding alkali for the oxygen stage either to the pulp upon being discharged from the pressure diffuser or to the washing liquid feeding into the pressure diffuser.

19. The method according to claim 17, further comprising feeding alkali and oxygen for the oxygen stage to the washing liquid feeding into the pressure diffuser.

20. The method according to claim 1 wherein the washing step includes at least one of a suction leg of a washer using sub-atmospheric pressure, and a press, whereby the filtrate from the washer or the press is at a pressure controlled by a bypass valve in the washer or press and an overflow fraction valve of the separation apparatus.

21. The method according to claim 20 wherein filtrate from the washer or press flows directly to a pressurized separation apparatus to separate soap from the filtrate.

22. The method according to claim 1 wherein the separation step takes place at a temperature above 100° C.

23. The method according to claim 1 further comprising feeding black liquor obtained from the digester to the pressurized separation device in which said black liquor is divided a liquid black liquor and the at least one of the soap, gas and other light materials.

24. The method according to claim 23, wherein the at least one of the soap, gas and other light materials are fed directly to a tall oil digesting step and the liquid black liquor is fed to an evaporation plant.

25. The method according to claim 23, wherein the separation of the black liquor is performed at a temperature above 100° C.

26. The method according to claim 23 wherein the essentially soap free black liquor flows to the evaporation unit for evaporation at a temperature above 100° C.

27. The method according to claim 1 wherein the separation step is performed using at least one of a hydrocyclone, a centrifuge and a pump.

28. An assembly for processing cellulose pulp:

a pressurized digester vessel having an inlet for wood chips and an outlet for pulp digested in the vessel;

a washer receiving the pulp from the digester vessel;

a bleaching device receiving washed pulp from the washer, and a pressurized separation apparatus receiving into a pressurized chamber filtrate from the washer, and discharging a liquid fraction to the digester vessel or the washer, wherein the pressurized chamber is at a pressure above atmospheric pressure at least while receiving the filtrate and discharging the liquid fraction.

29. The assembly according to claim 28 wherein the pressurized separation apparatus is in a liquid circulation between the digester vessel and a subsequent washer.

30. The assembly according to claim 28 wherein the pressurized separation apparatus is between the digester vessel and an evaporation plant that processes black liquor extracted from the digester vessel.

31. The assembly according to claim 28 wherein the washer is a two-staged pressure diffuser and an outlet of a second stage of the two-stage pressure diffuser is coupled to the inlet of the pressurized separation apparatus and the liquid filtrate discharge of the pressurized separation apparatus is coupled to an inlet of a second stage of the two-staged pressure diffuser.

32. The assembly according to claim 31 wherein said two-stage pressure diffuser includes a suction leg.

33. The assembly according to claim 28 wherein the pressurized separation apparatus is arranged to process the filtrate of the washer without a filtrate tank.

34. The assembly according to claim 28 wherein the washing apparatus includes a pressure diffuser.

35. The assembly according to claim 28, wherein the bleaching plant includes at least one of a high consistency pulp pump (MC pump), a bleaching reactor, and a pressure diffuser.

36. The assembly according to claim 28 wherein the pressurized device includes at least one of a hydrocyclone, a centrifuge and a pump.

37. A method of processing cellulose pulp of wood comprising: producing pulp by chemically digesting comminuted cellulosic fibrous material in a pressurized digesting vessel, wherein the pressure in the digesting vessel is above atmospheric pressure;

washing the pulp and discharging wash filtrate, wherein the bleached pulp is washed at a pressure above atmospheric pressure;

bleaching the pulp in a bleaching stage, wherein the pulp is bleached at a pressure above atmospheric pressure, and separating at least one of soap, gas and other light materials from the wash filtrate while the wash filtrate is under pressure greater than an atmospheric pressure and is in a pressurized separation device;

wherein the washing step uses a pressure diffuser to wash the digested pulp and the filtrate received by the pressurized separation device is received from the pressure diffuser and wherein the filtrate remains under a pressure above atmospheric pressure while flowing from the washing step to the pressurized separation device.

38. The method according to claim 37, wherein the washing step uses a pressure diffuser to wash the pressurized bleached pulp.

39. The method according to claim 37, further comprising discharging from the pressurized separation device the wash filtrate and separately discharging the soap separated from the wash filtrate.

40. The method according to claim 37, further comprising discharging the wash filtrate after being separated in the pressurized separation device and using the discharged wash filtrate as a wash liquid in another washing step of the bleached pulp.

41. The method according to claim 37, wherein the separation is performed using at least one of a hydrocyclone, a centrifuge and a pump.

42. The method accordingly to claim 37 wherein the steps of producing pulp, bleaching the pulp; washing the bleached pulp and discharging wash filtrate are performed while the pulp and the wash filtrate remain at a pressure above atmospheric pressure.

43. An assembly for processing cellulose pulp:

a pressurized digester vessel having an inlet for comminuted cellulosic fibrous material and an outlet for pressurized pulp chemically digested in the vessel;

a pressurized washer receiving the pressurized pulp from the pressurized digester vessel and discharging pressurized filtrate, a pressurized bleaching device receiving the pressurized pulp from the pressurized washer, and a pressurized separation apparatus configured to receive the pressurized filtrate from the pressurized washer, separate a liquid fraction from the pressurized filtrate while the pressurized filtrate remains at a pressure above atmospheric pressure, and discharge the liquid fraction to the digester vessel or the washer.

44. The assembly according to claim 43 wherein the washing apparatus includes a pressure diffuser operated at a pressure substantially above an atmospheric pressure.

45. The assembly according to claim 44 wherein said pressure diffuser includes a suction leg.

46. The assembly according to claim 43, wherein the bleaching device includes at least one of a high consistency pulp pump (MC pump), a bleaching reactor, and a pressure diffuser.

47. The assembly according to claim 43 wherein the separation apparatus includes at least one of a hydrocyclone, a centrifuge and a pump.

* * * * *